US005922402A

United States Patent [19]

Speeney

[11] Patent Number: 5,922,402

[45] Date of Patent: Jul. 13, 1999

[54] METHOD OF MAKING ADHESIVE TAPE WITH ADHESIVE FREE ZONES

[76] Inventor: Michael J. Speeney, 855 Tower View Cir., New Hope, Pa. 18938-9400

[21] Appl. No.: 08/800,369

[22] Filed: Feb. 14, 1997

Related U.S. Application Data

[60] Provisional application No. 60/011,730, Feb. 15, 1996.

[51] Int. Cl.[6] ..... B05D 5/12

[52] U.S. Cl. ..... 427/208.6; 427/211; 427/286; 427/358; 427/359; 427/385.5; 427/428

[58] Field of Search ..... 427/208.6, 211, 427/286, 358, 359, 385.5, 428

[56] References Cited

U.S. PATENT DOCUMENTS

| | | |
|---|---|---|
| 2,054,448 | 9/1936 | Russell . |
| 2,684,316 | 7/1954 | Warshaw . |
| 2,819,180 | 1/1958 | Koenig . |
| 4,647,485 | 3/1987 | Nelson . |
| 5,366,775 | 11/1994 | Kao . |

OTHER PUBLICATIONS

D.M. MacLeod, "An Introduction to Wire–Wound Rod Coating," *Industry Tech*, Oldsmar, Florida, pp. 103–111 (undated);

"Why Choose Carton Sealing Tapes Made with Acrylic Adhesives?", Brochure RRA–1, Rohm and Haas Co., Philadelphia, PA, pp. 1–7 (undated).

*Primary Examiner*—Bernard Pianalto
*Attorney, Agent, or Firm*—Panitch Schwarze Jacobs & Nadel, P.C.

[57] ABSTRACT

A method of manufacturing adhesive tape by applying a coating of liquid adhesive to a surface of a continuous web substrate moving in a longitudinal direction to create an adhesive-free zone on the web substrate that extends in a longitudinal direction between areas of adhesive coating on the web substrate and by contacting the surface of the moving continuous web substrate carrying the applied liquid adhesive coating with a rotating metering rod to obtain an adhesive coating with a predetermined specific thickness, wherein the metering rod has an elastomeric wiper contacting the rod and wiping the rod at a location along the length of the rod that corresponds to the transition between the adhesive-free zone and the adhesivecontaining zone on the coated web substrate, to prevent edge buildup of applied adhesive at the transition on the coated web substrate. Adhesive tape made by this method is characterized by having an adhesive coating of uniform thickness, being free of adhesive edge buildup in the coating adjacent to an adhesive-free zone on the tape.

15 Claims, 2 Drawing Sheets

METHOD OF MAKING ADHESIVE TAPE WITH ADHESIVE FREE ZONES

CROSS-REFERENCE TO RELATED APPLICATION

This patent application claims the benefit of Provisional U.S. application No. 60/011,730, filed Feb. 15, 1996.

BACKGROUND OF THE INVENTION

This invention relates to continuous tape having an adhesive on one surface, useful for sealing boxes or the like.

Coatings of an adhesive in liquid form are conventionally applied to a continuous web or substrate made of a flexible material. For example, many box sealing tapes in commercial use are made by applying a pressure-sensitive acrylic adhesive onto a polypropylene web.

The most widely used coating technique involves use of a wire-wound metering rod, also called a Mayer rod, doctor rod or applicator rod. The rod has a support core that is typically a stainless steel rod between about 0.15 inch (in.) to about 1 in. (about 3.8 to about 25 mm) in diameter, 0.25 in. (6.4 mm) diameter being typical, that is wound with a tightly wrapped spiral of wire, also typically stainless steel. The diameter of the wire is selected based on the coating thickness desired, e.g., one rule of thumb being a 1:10 ratio between the coating thickness and wire diameter so that a wire of 0.02 in. (0.51 mm) diameter on a wire-wound metering rod would produce a wet film coating of about 0.002 in. (2 mils or 0.051 mm) thickness.

In a coating apparatus, the moving continuous substrate web is passed via a conveyor system of rolls or rollers through a wetting station where the web is contacted on one surface with the wet adhesive, e.g., using an applicator roller coated with the adhesive or by immersion of the web into a tank containing the adhesive. The gross coated web is then passed to a metering station where the moving web passes above and contacts the wire-wound metering rod. This allows only a measured amount of adhesive coating to remain on the web, the excess liquid adhesive being returned by gravity to a reservoir of adhesive. The wire-wound metering rod is normally rotated, so that the area of contact of the metering rod moves either in the same direction or in the opposite direction to that of the web travel.

Although wire-wound metering rods provide a high degree of precise metering of liquid coating material onto the moving continuous web, this system typically results in an uneven adhesive thickness at the two edges of the coated web, at both ends of the wire-wound metering rod. Rubber wiper blades on the edges of the adhesive applicator roll have been typically used to prevent the coating from wrapping around the edge of the web and contaminating the uncoated side, but these are not effective in preventing adhesive edge beading or buildup.

In commercial practice, adhesive tape is made from wide webs are used in a full web coating process. The adhesive coated web is wound, after the adhesive is dried, on a support cylinder, e.g., a hollow cardboard cylinder, and the finished, wound reel is cut into appropriate widths, e.g., between 0.5 to 5 in. (12.7 to 127 mm), to make many rolls of wound adhesive tape. The lateral edge portions of the continuous wide web, which contains both uncoated web at its edge and the edge portion of the adhesive coating with the coating bead edge or uneven coating thickness, are normally slit off and discarded.

This edge slitting practice is necessary because, if the edge portion were to be wound onto the finished roll of coated tape, the presence of the edge buildup or edge unevenness would result in an unevenly wrapped roll. This discarded edge waste portion represents a significant added cost to the finished product, since the raw materials (i e., film substrate and adhesive) on the discarded waste portion cannot be recycled. Despite the longstanding existence of this problem and economic incentive for solving it, the box sealing tape industry has failed to develop a means for precisely metering a uniform thickness of a liquid coating of adhesive at the edge of the applied coating, without edge beading or buildup.

The problem of edge beading or buildup also exists with attempts to create adhesive-free stripes on sealing tapes of the type disclosed in U.S. Pat. No. 5,366,775 of Kao, which describes an adhesive tape with an adhesive-free strip-like area in the middle of the tape to facilitate easy peeling from the roll. U.S. Pat. No. 2,819,180 of Koenig describes a self-adhesive tape for specialty applications having two adhesive strips running in a longitudinal direction. No information is provided in either patent about how such tapes may be manufactured.

The present invention solves the problem of adhesive edge beading or buildup in tape manufacture and provides a method of manufacturing an economical grade of box sealing tape that has satisfactory sealing characteristics but that contains substantially less adhesive than conventional box sealing tapes.

BRIEF SUMMARY OF THE INVENTION

The present invention is directed to a method of manufacturing adhesive tape by (i) applying a coating of liquid adhesive to a surface between lateral edges of a continuous web substrate moving in a longitudinal direction, the liquid adhesive coating being applied over less than the entire area of the surface to create an adhesive-free zone on the web substrate, the adhesive-free zone extending in a longitudinal direction between areas of adhesive coating on the web substrate, such that a transition is created in a lateral direction on the coated surface of the web substrate between the adhesive-free zone and a zone containing adhesive coating; and (ii) contacting the surface of the moving continuous web substrate carrying the applied liquid adhesive coating with a rotating metering rod to obtain an adhesive coating with a predetermined specific thickness, the metering rod having an elastomeric wiper contacting the rod and the wiper being positioned to wipe the rod at a location along the length of the rod that corresponds to the transition between the adhesive-free zone and the adhesive-containing zone on the coated web substrate, to prevent edge buildup of applied adhesive at the transition on the coated web substrate. The coated adhesive on the web substrate is preferably thereafter subjected to a curing or drying step.

Another aspect of the invention involves applying the coating of liquid adhesive to the surface of the moving continuous web substrate from a rotating applicator roll which picks up a coating of liquid adhesive from a reservoir of liquid adhesive and wiping the applicator roll with a wiper positioned in contact with the roll between the adhesive pickup and a location at which the liquid adhesive coating is applied to the web substrate, the wiper having a width sufficient to wipe adhesive from the roll to create an adhesive-free zone on the applicator roll, thereby creating a corresponding adhesive-free zone on the surface of the web substrate to which the liquid adhesive coating is applied.

Still another aspect of the invention is adhesive tape made by this method. The adhesive-free zone may be in the form of one or more adhesive-free stripes that extend in the longitudinal direction of the tape and may also be at the edge, or both edges, of the coated web substrate.

BRIEF DESCRIPTION OF THE SEVERAL VIEWS OF THE DRAWINGS

The foregoing summary of the invention, as well as the following detailed description of preferred embodiments, will be better understood when read in conjunction with the appended drawings. For the purpose of illustrating the invention, there is shown in the drawings an embodiment which is presently preferred, it being understood, however, that the invention is not limited to the specific arrangements and instrumentalities disclosed. In the drawings:

FIG. 3 is a view along the line 3—3 in FIG. 4.

DETAILED DESCRIPTION OF THE INVENTION

The present invention concerns the manufacture of box sealing tape having one or more longitudinal portions of tape on the adhesive side that are free of adhesive and that exhibit no adhesive edge beading or buildup at the transition, or transition point or area, across the lateral dimension of the tape, between adhesive-carrying and adhesive-free zones on the tape substrate. The adhesive-free portions may have the appearance of one or more continuous stripes running in the longitudinal direction of the tape. Such adhesive-free portions of the tape may constitute from about 10% to about 80% of the surface area of the adhesive-containing side of the tape. In addition, adhesive-free zones may be located along either or both lateral edges of the continuous tape web substrate, which is ordinarily removed by slitting during production of finished tape rolls that are cut from a wound reel of adhesive-coated tape. The adhesive applied on the portions of the tape containing adhesive is of the same type and same thickness as is conventionally used in box sealing tape containing adhesive on the entire area of one side of the tape, i.e., full web coating.

Although the objective of this invention may seem to be simple and straightforward, i.e., adhesive-free zones, the lack of a means for accomplishing this objective has been longstanding because of the unsolved problem of adhesive edge beading and buildup, as described in the "Background of the Invention". The lack of a method for manufacturing the tape of this invention is demonstrated by the fact that no box sealing tape is presently being manufactured and sold that embodies this invention, despite the strong economic incentive in the box sealing tape industry to provide more economical grades of such adhesive tape that use less adhesive.

The adhesive tape of this invention may be made using the same coating equipment line used for producing conventional adhesive tape, with modifications that do not require a significant capital investment and that do not require major alterations in manufacturing procedures.

Figure 1:
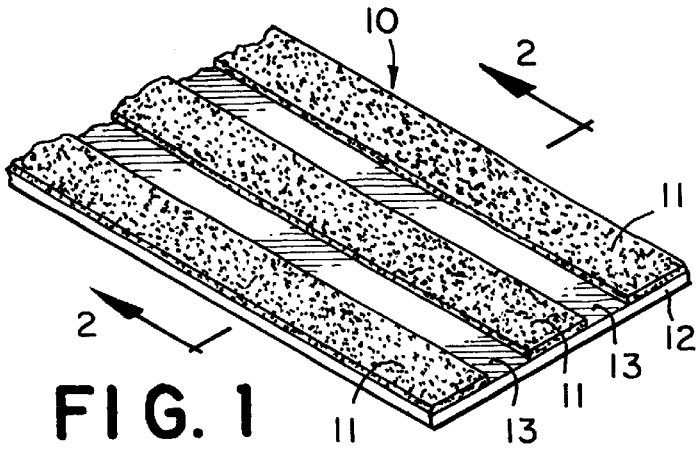
FIG. 1 is a perspective view of an adhesive tape of this invention, having two adhesive-free zones that extend in the longitudinal direction.
Figure 2:
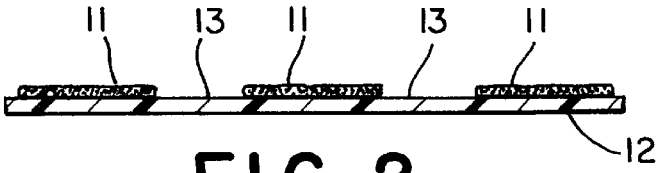
FIG. 2 is a cross-section view, along the line 2—2 in FIG. 1, of the adhesive tape showing the adhesive-free zones and the uniform thickness of the adhesive coated portions.

Referring now to the drawing, the adhesive tape 10 made by the method of this invention is shown in FIGS. 1 and 2 and comprises a tape substrate 12 that contains three adhesive portions 1, extending in the longitudinal direction of the tape and characterized by being free of edge beading, and the adhesive-free zones or stripes 13, also extending in the longitudinal direction. In the preferred embodiment shown in FIGS. 1 and 2, the adhesive portions 1 are a pressure-sensitive acrylic polymer resin, and the tape substrate 12 is polypropylene film. The adhesive is applied in liquid form to the substrate 12 and, after being treated with a metering rod as described below to obtain a precise coating thickness, is subsequently dried to provide the adhesive portions 1.

Figure 3:
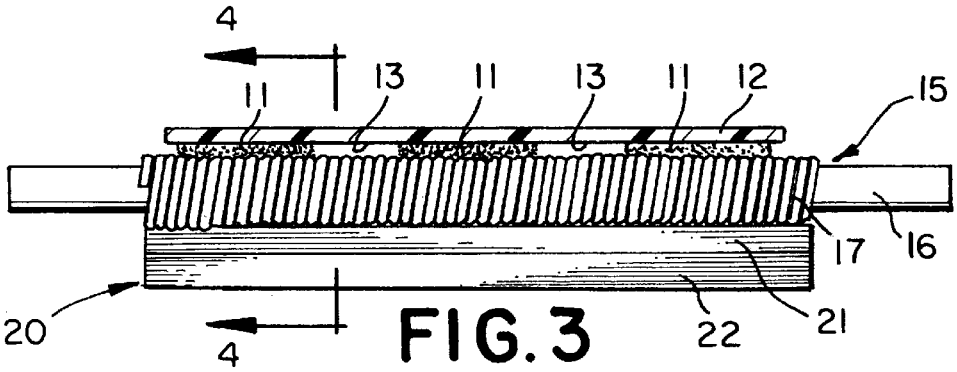
FIG. 3 is a front elevation view of the metering rod used to meter the thickness of the adhesive coating on the adhesive tape substrate, the substrate being shown in cross section above the rod traveling in an oncoming direction, and the elastomeric pad used to wipe the length of the rotating metering rod is shown below the rod.
Figure 4:
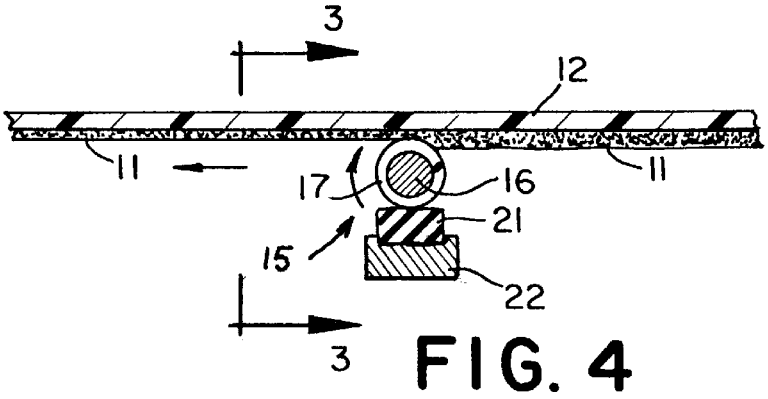
FIG. 4 is a cross-section view, along the line 4—4 in FIG. 3, showing the wire-wound metering rod metering a specific coating thickness of applied adhesive on the adhesive tape substrate travelling to the left and showing the elastomeric pad and support member below the rod.

The adhesive-free zones 13 and uniform-thickness adhesive portions 11 of the adhesive-coated tape 10 may be made as follows, and reference should be made to FIGS. 3–7. As shown in FIGS. 3 and 4, a wiper assembly 20 includes an elastomeric pad 21 that is pressed against a metering rod 15 that is a solid metal rod 16 which is spirally wound with wire 17 along the entire length of the rod 16. The elastomeric pad 21 is made of an elastomeric material such as rubber, but other materials having the flexibility and resiliency characteristics of an elastomer may also be used. The metering rod 15 may be any metering rod that is conventionally used for providing an applied liquid adhesive coating of predetermined thickness on a substrate, and such wire-wound metering rods are well-known in the coating art. The diameter of the wire 17 used for wrapping rod 16 is the parameter which is normally used to control the coating thickness obtained with the metering rod 15, as is well known to those skilled in the coating art.

The elastomeric pad 21, held in a support member 22 and mounted to the equipment framework by brackets (not shown), serves to wipe excess liquid adhesive off of the wire-wound metering rod 15. In particular, adhesive on the outermost radius portion of the wound wire metering rod 15 is removed by the wiping action of the elastomeric pad 21. It has surprisingly and unexpectedly been discovered that such wiping of adhesive on the surface of the metering rod 15 serves to eliminate formation of an adhesive edge bead or buildup at the point, area or region on the substrate where the adhesive coating ends and an adhesive-free zone begins, i e., the transition between adhesive-containing and adhesive-free zones in the lateral direction on the tape substrate. As a consequence, the adhesive coating thickness of the adhesive portions 11 is uniform over the entire coating area, even at the edge of the coated area adjacent to an adhesive-free zone, as shown in FIG. 1 and particularly in FIG. 2.

Figure 5:
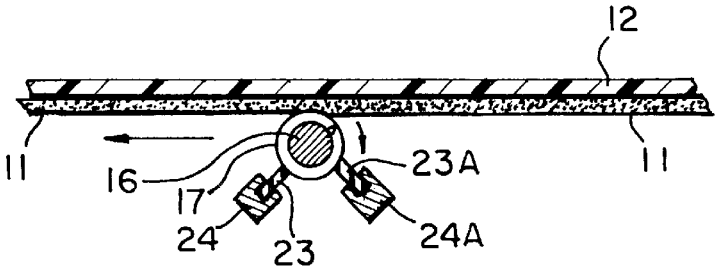
FIG. 5 is a cross-section view of a second embodiment of the elastomeric wiper (not shown in the other drawings), showing two separate elastomeric blades with support members used to wipe the length of the rotating metering rod.

FIG. 5 illustrates a preferred alternative embodiment of the elastomeric wiper having a set of two separate blades 23, 23A, instead of the elastomeric pad 21 shown in FIGS. 3 and 4. The blades 23, 23A are made of an elastomeric material and are supported by support members 24, 24A shown in FIG. 5. It is also possible to use only a single elastomeric blade instead of the two blades 23, 23A of FIG. 5, analogous to the single elastomeric pad 21 of FIGS. 3 and 4.

Figure 6:
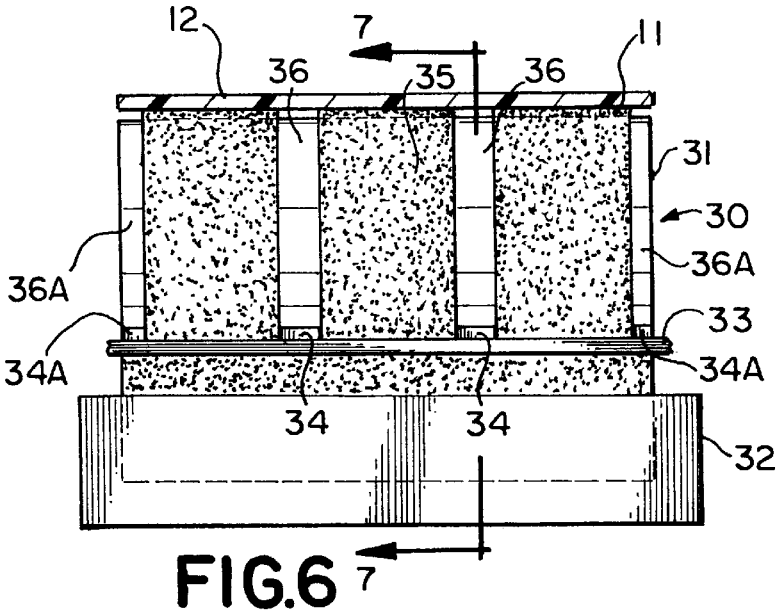
FIG. 6 is a front elevation view of the adhesive applicator roll used to apply the adhesive onto the adhesive tape substrate shown in cross section above the applicator roll and shows the wiper blades used to remove adhesive from the portions of the applicator roll that correspond to the adhesive-free zones on the coated adhesive tape; edge wipers are also shown.
Figure 7:
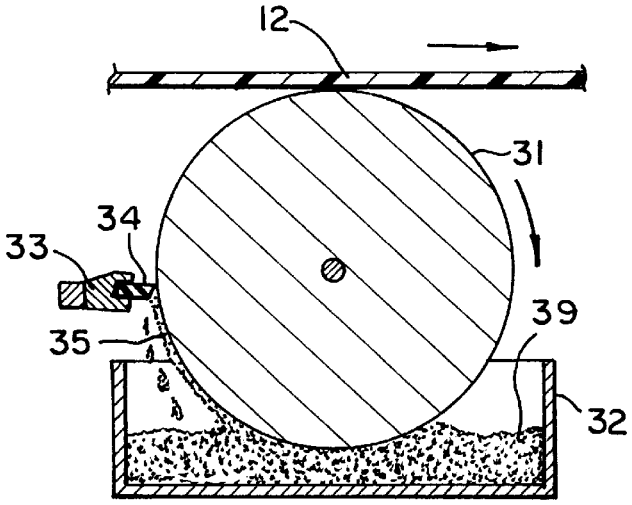
FIG. 7 is an instant cross-section view, along the line 7—7 in FIG. 6, that shows the applicator roll being wiped clear of adhesive, so that the moving adhesive tape substrate receives no application of adhesive in the adhesive-free zones of the tape that is shown in this view.

The adhesive-free zones may be created on the continuous web substrate that is coated with adhesive and used to make the adhesive tape by any of several techniques. A preferred procedure of applying liquid adhesive to the continuous web substrate involves the use of an applicator roll that is immersed in a reservoir of liquid adhesive and then contacted with the moving continuous web substrate to transfer a coating or layer or adhesive to the surface of the web substrate, as is shown in FIGS. 6 and 7. The preferred procedure described below utilizes the applicator roll to create not only adhesive-containing coating zones on the surface of the web substrate but also adhesive-free zones as well.

Referring now to FIG. 6, an applicator roll adhesive coating station in an adhesive tape manufacturing line is shown generally as 30, and this applicator roll coating station is located upstream of the metering rod which controls the thickness of the applied coating of adhesive on the substrate. FIG. 7 shows a cross-section side view of the applicator roll taken through line 7—7 in FIG. 6. The applicator roll 31 in FIGS. 6 and 7 is rotated (see arrow in FIG. 7) so as to pick up a layer or coating 35 of liquid adhesive from a trough or reservoir 32 containing a supply of liquid adhesive 39. The liquid adhesive 35 on the surface of the applicator roll 31 is contacted with a surface of a moving (see arrow in FIG. 7) continuous web substrate 12 to transfer adhesive 35 from the applicator roll 31 to the surface of the web substrate 12 passing from its area of contact with the applicator roll 31.

Adhesive-free zones 36 on the applicator roll surface carrying the coating 35 of liquid adhesive are created as follows. Elastomeric wipers 34, as shown in FIGS. 6 and 7, are positioned with a support means 33, mounted to the equipment framework by brackets (not shown), to contact the cylindrical surface of the applicator roll 31 to wipe adhesive 35 off of the applicator roll at locations 36 that correspond to locations on the web where the adhesive-free zone or zones 13 are desired to be created. Edge zones 36A, at one or both edges of the applicator roll 31, may also be wiped with elastomeric end wipers 34A. Adhesive removed from the applicator roll by the wipers 34, 34A is returned by gravity to adhesive supply 39 in trough 32.

The width of the uncoated portion of the web is determined by the width of the elastomeric wiper(s) along the adhesive applicator roll. It has been found that the width of the uncoated, adhesive-free zone or stripe 13 (FIG. 1) created on the surface of the web substrate is typically slightly less, e.g., about 0.1 to about 0.3 in. (about 2.5 to about 7.6 mm), than the width of the elastomeric wiper 34 (FIG. 6) for the applicator roll. Thus, precise widths of non-adhesive zones, i e., the non-adhesive stripe widths, may be obtained through appropriate selection of the width of the elastomeric wiper(s).

Multiple uncoated portions, e.g., more that one adhesive-free zone or stripe, may be utilized, and these adhesive-free zones may be of similar or unequal width, as desired. The multiple uncoated adhesive-free zones should be positioned so that the sealing characteristics of the finished tape roll are not impaired, i.e., so that the adhesive-containing zones 11 (FIG. 1) on the tape provide acceptable adhesive functionality or sealing when the tape is employed in its intended manner of use, e.g., for sealing box flaps or the like. As many as 20 adhesive-free zones could be used, but between about 1 to 5 adhesive-free zones or stripes are preferred, and more preferably 1 to 3, for commonly-used commercial box sealing tape widths, e.g., about 1.42 in. (36 mm) to about 5.67 in. (144 mm).

It should be recognized that these typical widths utilized with commercial box sealing tapes are obtained by slitting such roll widths from a wound reel of adhesive tape made by coating adhesive onto a continuous web substrate, curing or drying the adhesive-coated substrate and winding the cured or dried coated tape onto a long support cylinder that is normally a cardboard tube. Such a reel of adhesive tape may be from about 24 in. to about 80 in. (about 61 cm to about 203 cm) or more in width, i.e., the lateral dimension of the tape reel. Prior to slitting the reel of adhesive tape into individual rolls, the coated tape on such a reel will contain multiple adhesive-free zones, the total number corresponding to the number of such zones per individual finished roll multiplied by the number of such rolls obtainable from slitting the reel into finished rolls of desired width.

The total area of adhesive-free zones on the side of the tape bearing the adhesive should range from about 10% to about 80%, more preferably about 15% to about 70% and most preferably about 20% to about 60% of the tape surface, based on the total surface area of the coated side of the tape substrate. These percentage ranges are applicable to adhesive tape made by the method of this invention where the adhesive-free zones are located between the lateral edges of the tape or between areas of adhesive coating on the continuous web substrate.

However, these percentage ranges are not applicable to a situation where the method of this invention is used to make adhesive-free zones along one or both edges of the continuous web substrate, to minimize the amount of waste that needs to be trimmed from such edges by avoiding formation of an adhesive edge bead or adhesive buildup at the edge of the tape substrate being coated. In such cases, the adhesive-free zone is desirably minimized to obtain the maximum feasible adhesive coated area near the edges of the web substrate being coated, so as to reduce to a minimum the amount of uncoated edge required to be slit and discarded from the edge of the coated web substrate.

The adhesive tape of this invention, with its single or multiple adhesive-free zones, will typically present an appearance of having stripes on the adhesivebearing side, the stripes running in the longitudinal direction of the tape, and this is best shown in FIG. 1. As shown by the cross-section view in FIG. 2, the coated areas of the adhesive tape are noteworthy for their uniform thickness, being free of any undesirable adhesive edge beading or buildup, particularly near the transition between an adhesive-containing portion 11 and an adhesive-free zone 13 on the coated surface of the tape.

Box sealing tape widths, cut from the finished roll of adhesive-coated web, may typically be about 1.42 in. (36 mm) to about 3.78 in. (96 mm), with 1.42 in. (36 mm) being preferred for economy grades and 1.89 in. (48 mm) and 2.83 in. (72 mm) being preferred for regular grades.

The lateral dimension of the uncoated portion, ie., adhesive-free zone 13, of the coated adhesive tape is generally not critical and may range from a width of about 0.1 in. to about 5 in. (about 2.5 mm to about 130 mm) but could be wider if desired. The width of the adhesive-free zone 13 is more preferably about 0.2 to about 3 in. (about 5.1 to about 76 mm), and is most preferably about 0.3 to about 0.5 in. (about 7.6 to about 13 mm).

By way of illustration, a 1.9 in. (48 mm) wide tape cut from a wide web(e.g., 24–80 in. (61–203 cm) wide) may be made with two adhesive-free zones that are 0.275 in. (7 mm) wide. A 5.67 in. (144 mm) tape may be made with a single centrally located adhesive-free zone that is 2.76 in. (70 mm) wide or with multiple (2, 3 or 4) adhesive-free zones/stripes of about 0.75 in. (about 19 mm) in width, equally spaced across the lateral span or width of the tape.

This invention is particularly well-suited for use with thermoplastic synthetic resin adhesives. One highly preferred class of adhesive is pressure-sensitive acrylic polymer resins. Such adhesives are used in conventional fully coated adhesive tapes used for box sealing. Other adhesives and adhesive systems that are conventionally applied to a continuous moving web via a wire-wound metering rod are likewise suitable for use in the present invention. After application of the liquid adhesive to the tape substrate and treatment of the adhesive coating with the metering bar as described above, the adhesive coating is preferably dried or cured, depending on the nature of the adhesive system being used, to permit the coated tape to be wound onto a reel.

Tape thickness, of finished adhesive tape also including the dried adhesive coating thickness, typically is about 0.0015 in. (about 1.5 mil or about 0.038 mm) to about 0.005 in. (about 5 mil or about 0.13 mm).

A preferred thickness for regular box sealing tape grades is about 0.0019 in. (about 1.9 mil or about 0.048 mm) having a film thickness of about 0.0012 in. (about 1.2 mil or about 0.030 mm) and adhesive coating thickness of about 0.00070–0008 in. (about 0.7–0.8 mil or about 0.018–0.020 mm). A preferred thickness for economy box sealing tape grades is about 0.0016 in. (about 1.6 mil or about 0.041 mm) having about 0.0009 in. (about 0.9 mil or about 0.023 mm) film thickness and about 0.0007 in. (about 0.7 mil or about 0.018 mm) adhesive coating thickness.

The elastomeric pad or blade used for the metering rod, as well as the elastomeric wiper used with an applicator roll, are preferably made of an elastomeric material such as a natural or synthetic rubber. Other materials having elastomeric properties similar to rubber and being resistant to degradation from contact with the liquid adhesive and the rotating applicator roll and/or rotating metering rod may also be used.

The objective of using the elastomeric blade or pad is to wipe liquid adhesive from the portion of the wire-wound metering rod being contacted with the elastomeric element. Such wiping action may be achieved with a blade, i e., edge, or with a pad, i.e., extended surface. Two blades or pads may be used in tandem; see FIG. 5. Although the elastomeric blade or pad preferably extends across the entire length of the metering rod, shorter sections, extending across the lateral locations on the metering rod that correspond to a transition between an adhesive-coated portion and an adhesive-free zone on the surface of the web substrate being coated, could also be used.

Based on the disclosure of this invention, one skilled in the art would recognize that alternative wiping means could be employed to accomplish the same objectives as that provided by the elastomeric wiper for the adhesive applicator roll. For example, a precisely directed air stream or air jet could be used to provide the equivalent of wiping of liquid adhesive from a portion of the applicator roll. Such alternative wiping means are intended to be within the scope of the invention disclosed herein.

Likewise, the liquid adhesive may be applied to the continuous web substrate by procedures other than use of an applicator roll as described above to provide areas of adhesive coating on the substrate with adjacent adhesive-free zones, such as spraying or extrusion of the liquid adhesive onto the moving continuous web substrate. Regardless of the alternative liquid adhesive application procedure utilized, the coating of liquid adhesive on the continuous web substrate is subsequently metered to a predetermined coating thickness with the metering rod as described above.

The invention is further illustrated by the following nonlimiting Example.

EXAMPLE

A continuous box sealing tape coating operation is carried out using a 24 to 80 in. (61 to 203 cm) wide web of polypropylene film (1.2 mil thickness or 0.030 mm thickness)coated with a Rhoplex® No. 2437 acrylic adhesive (Rohm & Haas Co., Philadelphia, Penn.), an aqueous emulsion containing about 50% by weight solids. The web is coated at 500 ft/min (152 m/min) using an applicator roll to apply the liquid adhesive coating emulsion to the substrate. The applicator roll is operated at 75 rpm, in a rotational direction that is the same as the web travel direction but at a slightly lower linear speed than the web speed.

Adhesive-free zones or stripes of widths of about 0.125 in. (3.2 mm) are created by positioning rubber wipers (whose widths are substantially equivalent to the zone/stripe widths) on the adhesive applicator roll at the positions corresponding to the locations desired for the adhesive-free zones. In addition, rubber wipers are positioned at the edges of the applicator roll at locations corresponding to the lateral edges of adhesive on the adhesive-coated web.

The coating thickness was controlled with a wire-wound metering rod, whose stainless steel core was about ¾ in. (about 19 mm) in diameter and whose core was wrapped spirally with stainless steel wire.

Tension on the web was maintained at about 2 lb/linear inch (about 3.5 newtons/linear cm).

Sufficient pressure is maintained on the wiper blades to remove adhesive adhering to the outermost portion of the spirally-wound wire on the metering rod.

The coated tape was dried in a forced hot air drier before being wound on a take-up reel. The tape as wound on the take-up reel exhibited no evidence of edge beading or buildup, and the wound tape roll contained no bulges at the transition areas or transition points between adhesive-containing and adhesive-free zones (such bulges being typical of adhesive edge beading or buildup). In addition, the lateral edges of the wound tape likewise exhibited no signs of edge beading, so the amount of tape web edge that needed to be removed during slitting was substantially less that is ordinarily required to remove the adhesive edge bead that forms on conventionally coated adhesive tape.

The wound tape is cut into 1.9 in. (48 mm) widths, with each tape roll having two adhesive-free stripes, for end use applications such as box sealing. The resulting tape, when used to seal cardboard cartons, or the like, provides sealing characteristics similar to prior art box sealing tape.

It will be appreciated by those skilled in the art that changes could be made to the embodiments described above without departing from the broad inventive concept thereof. It is understood, therefore, that this invention is not limited to the particular embodiments disclosed, but is intended to cover modifications within the spirit and scope of the present invention as defined by the appended claims.

What is claimed is:

1. A method of manufacturing adhesive tape which comprises (i) applying a coating of liquid adhesive to a surface between lateral edges of a continuous web substrate moving in a longitudinal direction, the liquid adhesive coating being applied over less than the entire area of the surface to create an adhesive-free zone on the web substrate, the adhesive-free zone extending in a longitudinal direction between areas of adhesive coating on the web substrate, such that a transition is created in a lateral direction on the coated surface of the web substrate between the adhesive-free zone and a zone containing adhesive coating; and (ii) contacting the surface of the moving continuous web substrate carrying the applied liquid adhesive coating with a rotating metering rod to obtain an adhesive coating with a predetermined specific thickness, the metering rod having an elastomeric wiper contacting the rod and the wiper being positioned to wipe the rod at a location along the length of the rod that corresponds to the transition between the adhesive-free zone and the adhesive-containing zone on the coated web substrate, to prevent edge buildup of applied adhesive at the transition on the coated web substrate.

2. The method of claim 1 which comprises a subsequent step of subjecting the coated adhesive on the continuous web substrate to a step selected from the group consisting of drying and curing.

3. The method of claim 1 wherein the metering rod is a wire-wound metering rod.

4. The method of claim 1 wherein the wiper used for wiping the metering rod extends across the entire width of the metering rod.

5. The method of claim 1 wherein the wiper used for wiping the metering rod is selected from the group consisting of an elastomeric wiper blade and an elastomeric pad.

6. The method of claim 1 wherein the adhesive-free zone on the adhesive-coated web substrate has a width of about 0.1 in. to about 5 in. (about 2.5 mm to about 130 mm).

7. The method of claim 1 wherein the area of the adhesive-free zone is from about 10% to about 80% of the surface area of the continuous web substrate, based on the total area of the web substrate surface carrying the adhesive coating.

8. The method of claim 1 wherein the area of the adhesive-free zone is from about 20% to about 60% of the surface area of the continuous web substrate, based on the total area of the web substrate surface carrying the adhesive coating.

9. The method of claim 8 wherein the area of the adhesive-free zones is from about 20% to about 60% of the surface area of the continuous web substrate, based on the total area of the web substrate surface carrying the adhesive coating.

10. The method of claim 1 wherein more than one adhesive-free zone is created on the continuous web substrate.

11. The method of claim 1 which further comprises applying the coating of liquid adhesive to the surface of the moving continuous web substrate from a rotating applicator roll which picks up a coating of liquid adhesive from a reservoir of liquid adhesive and wiping the applicator roll with a wiper positioned in contact with the roll between the adhesive pickup and a location at which the liquid adhesive coating is applied to the web substrate, the wiper having a width sufficient to wipe adhesive from the roll to create an adhesive-free zone on the applicator roll, thereby creating a corresponding adhesive-free zone on the surface of the web substrate to which the liquid adhesive coating is applied.

12. The method of claim 11 wherein more than one adhesive-free zone is created on the continuous web substrate and the applicator roll is wiped with more than one wiper.

13. The method of claim 11 wherein the wiper on the applicator roll is of a width sufficient to provide an adhesive-free zone on the adhesive-coated web substrate of about 0.1 in. to about 5 in. (about 2.5 mm to about 130 mm).

14. The method of claim 1 wherein the adhesive is a pressuresensitive acrylic polymer resin.

15. The method of claim 1 wherein the continuous web substrate is polypropylene film.

* * * * *